US008360643B2

(12) United States Patent
Komro et al.

(10) Patent No.: US 8,360,643 B2
(45) Date of Patent: Jan. 29, 2013

(54) PACKAGE HAVING A RESEALABLE POUR SPOUT

(75) Inventors: Ronald Komro, Smyrna, GA (US); Nathan Franklin, Atlanta, GA (US); Edward J. Cigallio, Douglasville, GA (US)

(73) Assignee: Printpack Illinois, Inc., Elgin, IL (US)

( * ) Notice: Subject to any disclaimer, the term of this patent is extended or adjusted under 35 U.S.C. 154(b) by 263 days.

(21) Appl. No.: 12/978,793

(22) Filed: Dec. 27, 2010

(65) Prior Publication Data

US 2012/0163739 A1 Jun. 28, 2012

(51) Int. Cl.

| | |
|---|---|
| ***B65D 33/00*** | (2006.01) |
| ***B65D 30/08*** | (2006.01) |
| ***B65D 30/20*** | (2006.01) |
| ***B31B 1/64*** | (2006.01) |
| ***B31B 1/84*** | (2006.01) |
| ***B31B 1/26*** | (2006.01) |

(52) U.S. Cl. ..... 383/203; 383/211; 383/111; 383/120; 383/906; 493/199; 493/213; 493/231; 493/927; 493/933

(58) Field of Classification Search ..... 383/203, 383/204, 210, 211, 120, 111, 906; 493/189, 493/199, 213, 231, 243, 927, 933
See application file for complete search history.

(56) References Cited

U.S. PATENT DOCUMENTS

| | | | | |
|---|---|---|---|---|
| 2,093,977 | A | 9/1937 | Farmer | |
| 4,332,344 | A | 6/1982 | Strodthoff | |
| 4,953,708 | A | 9/1990 | Beer et al. | |
| 5,401,533 | A * | 3/1995 | Borland | 427/208.2 |
| 5,547,284 | A | 8/1996 | Imer | |
| 6,164,826 | A | 12/2000 | Petkovsek | |
| 6,325,543 | B1 | 12/2001 | Ausnit | |
| 6,352,365 | B1 | 3/2002 | Healy et al. | |
| 6,820,391 | B2 * | 11/2004 | Barmore et al. | 53/133.4 |
| 6,971,794 | B2 | 12/2005 | Yeager | |
| 6,988,828 | B2 | 1/2006 | Linneweil | |

(Continued)

FOREIGN PATENT DOCUMENTS

EP 1873083 B1 6/2009

OTHER PUBLICATIONS

PCT International Search Report and Written Opinion for PCT/US2011/067237 mailed Apr. 11, 2012.

*Primary Examiner* — Jes F Pascua
(74) *Attorney, Agent, or Firm* — Sutherland Asbill & Brennan LLP

(57) ABSTRACT

A package formed of a package material comprising a heat-sealable inner layer, an outer layer, and a pressure-sensitive adhesive disposed between the inner layer and the outer layer. The package may include a gusset with a center fold that divides the gusset into a first folded portion and a second folded portion. The package may further include a transverse heat-seal region extending across the gusset whereby the first folded portion is sealed to itself by mating surfaces of the heat-sealable inner layer and the second folded portion is sealed to itself by mating surfaces of the heat-sealable inner layer. The package may also include a patterned die cut formed in the heat-sealable inner layer, wherein at least a portion of the patterned die cut is adjacent to the transverse heat-seal region of the gusset so as to allow a portion of the inner layer to delaminate and expose a portion of the pressure-sensitive adhesive when the center fold is unfolded and the resealable pour spout is opened.

20 Claims, 4 Drawing Sheets

U.S. PATENT DOCUMENTS

| | | | | |
|---|---|---|---|---|
| 7,204,641 | B2 | 4/2007 | Stolmeier | |
| 8,091,323 | B2 * | 1/2012 | Paterson | 53/469 |
| 2004/0208402 | A1 | 10/2004 | Yeager | |
| 2008/0008406 | A1 | 1/2008 | Russell et al. | |
| 2010/0247003 | A1 * | 9/2010 | Huffer et al. | 383/207 |
| 2012/0177307 | A1 * | 7/2012 | Duan et al. | 383/211 |

* cited by examiner

PACKAGE HAVING A RESEALABLE POUR SPOUT

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention is generally in the field of flexible packaging. More particularly, the present invention is directed to packages having a resealable pour spouts and methods for making the same.

Flexible packages are widely used for storing items such as salty snacks and other food items. More recently it has become common to employ reclosing features on flexible packages to allow a consumer to consume a portion of the contents of the package and then reseal the remaining contents in the package for later consumption. Examples of such reclosing features include zippers and interlocking members which allow opposing sides of the packages to be mechanically joined together. Such reclosing features are commonly manufactured in an off-line production process and are later added to the flexible package at a forming or sealing stage. There are many disadvantages with employing such reclosing features including the associated operating and equipment costs for manufacturing the reclosing features and the operating and equipment costs associated with integrating the reclosing features with the flexible packages.

Accordingly, it would be desirable to provide new flexible packages that avoid the disadvantages associated with conventional reclosing features. Moreover, it would be desirable to provide new methods of manufacturing such flexible packages.

BRIEF SUMMARY OF THE INVENTION

In one aspect, a package having a resealable pour spout is provided. The package may be formed of a package material comprising a heat-sealable inner layer, an outer layer, and a pressure-sensitive adhesive disposed between the inner layer and the outer layer. The package includes a gusset formed of the package material, wherein the gusset has a center fold that divides the gusset into a first folded portion and a second folded portion. The package may further include a transverse heat-seal region extending across the gusset whereby the first folded portion is sealed to itself by mating surfaces of the heat-sealable inner layer and the second folded portion is sealed to itself by mating surfaces of the heat-sealable inner layer. The package may also include a patterned die cut formed in the heat-sealable inner layer, wherein at least a portion of the patterned die cut is adjacent to the transverse heat-seal region of the gusset so as to allow a portion of the inner layer to delaminate and expose a portion of the pressure-sensitive adhesive when the center fold is unfolded and the resealable pour spout is opened.

In another aspect, a package having a resealable pour spout, which includes a tube wall having a heat-sealable inner layer, an outer layer, and a pressure-sensitive adhesive disposed between the inner layer and the outer layer, is provided. The package may include a side gusset formed in the tube wall, wherein the side gusset has a center fold that divides the gusset into a first folded portion and a second folded portion. The package may further include a transverse heat-seal region extending in a transverse direction across the tube wall and extending across the side gusset proximal to form an end seal whereby the first folded portion is sealed to itself by mating surfaces of the heat-sealable inner layer and the second folded portion is sealed to itself by mating surfaces of the heat-sealable inner layer. The package may also include at least one patterned die cut formed in the heat-sealable inner layer, wherein at least a portion of the patterned die cut being adjacent to the transverse heat-seal region of the gusset so as to allow a portion of the inner layer to delaminate and expose a portion of the pressure-sensitive adhesive when the center fold is unfolded and the resealable pour spout is opened.

In another aspect, a method of manufacturing a package with a resealable pour spout is provided. The method may include providing a continuous web of a package material comprising a heat-sealable inner layer, an outer layer, and a pressure-sensitive adhesive disposed between the inner layer and the outer layer; cutting a patterned die cut through the heat-sealable inner layer; folding the package material such that the patterned die cut is located within a gusset, the gusset having a center fold that divides the gusset into a first folded portion and a second folded portion; and heat sealing the package material to form a transverse heat-seal region extending across the gusset and proximal to the patterned die cut whereby the first folded portion is sealed to itself by mating surfaces of the heat-sealable inner layer and the second folded portion is sealed to itself by mating surfaces of the heat-sealable inner layer.

DETAILED DESCRIPTION OF THE INVENTION

Figure 1:
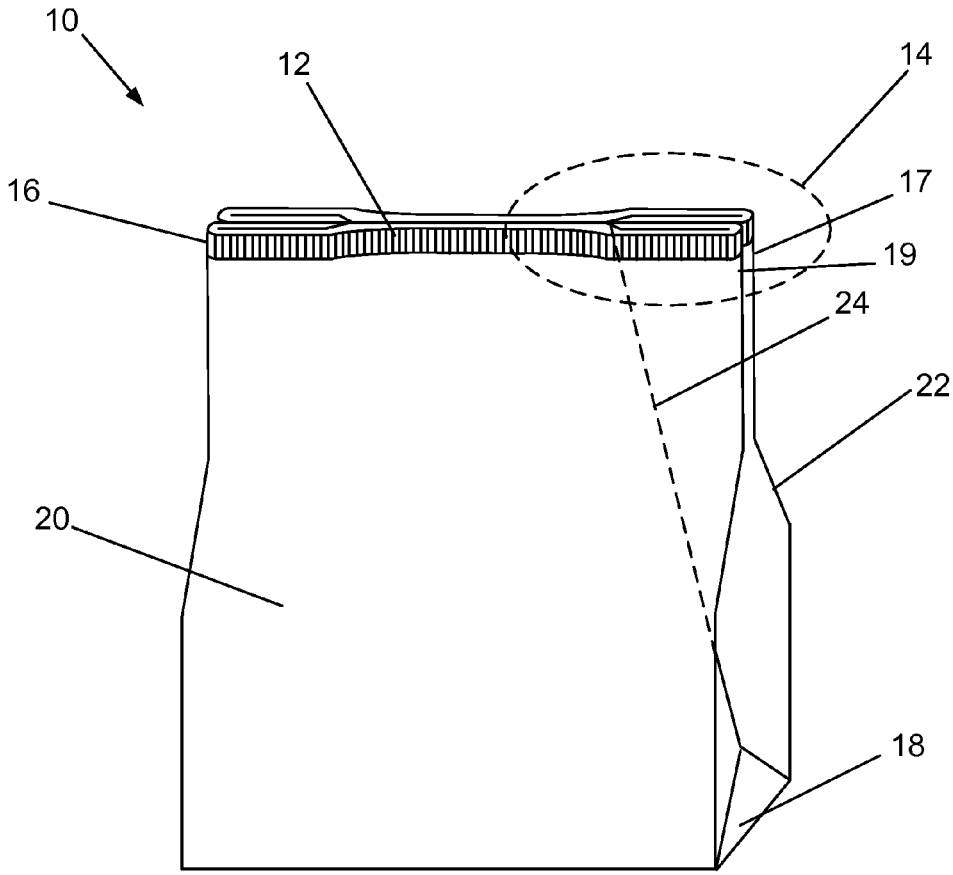
FIG. 1 is a perspective view, illustrating a flexible package in accordance with one or more embodiments of the present invention.

Packages having resealable pour spouts and methods for manufacturing such packages are provided. Advantageously, certain embodiments of such packages may be produced at relatively low cost and with good and consistent quality.

A. Packages Having Resealable Pour Spouts

In one aspect, a package having a resealable pour spout is provided. The package may be formed of a package material comprising a heat-sealable inner layer, an outer layer, and a pressure-sensitive adhesive disposed between the inner layer and the outer layer. The package may include a gusset formed of the package material, wherein the gusset has a center fold that divides the gusset into a first folded portion and a second folded portion. The package may further include a transverse heat-seal region extending across the gusset whereby the first folded portion is sealed to itself by mating surfaces of the heat-sealable inner layer and the second folded portion is sealed to itself by mating surfaces of the heat-sealable inner layer. The package may also include a patterned die cut formed in the heat-sealable inner layer, wherein at least a portion of the patterned die cut being adjacent to the transverse heat-seal region of the gusset so as to allow a portion of the inner layer to delaminate and expose a portion of the pressure-sensitive adhesive when the center fold is unfolded and the resealable pour spout is opened.

In another aspect, a package having a resealable pour spout, which includes a tube wall having a heat-sealable inner layer, an outer layer, and a pressure-sensitive adhesive disposed between the inner layer and the outer layer, is provided. The package may include a side gusset formed in the tube wall, wherein the side gusset has a center fold that divides the gusset into a first folded portion and a second folded portion. The package may further include a transverse heat-seal region extending in a transverse direction across the tube wall and extending across the side gusset proximal to an end to form an end seal whereby the first folded portion is sealed to itself by mating surfaces of the heat-sealable inner layer and the second folded portion is sealed to itself by mating surfaces of the heat-sealable inner layer. The package may also include at least one patterned die cut formed in the heat-sealable inner layer, wherein at least a portion of the patterned die cut being adjacent to the transverse heat-seal region of the gusset so as to allow a portion of the inner layer to delaminate and expose a portion of the pressure-sensitive adhesive when the center fold is unfolded and the resealable pour spout is opened.

In some embodiments, the package further includes a second gusset formed of the package material. In certain embodiments, the two gussets may be formed on opposite sides of the tube wall, such that the gussets divide the tube wall into a forward-facing panel and a rearward facing panel.

In some embodiments, the package may include additional layers between the inner and outer layers. For example, in certain embodiments, the package material may include a print layer that is disposed between the outer layer and the pressure-sensitive adhesive. Additional layers, such as layers having good oxygen barrier properties may be added for improved performance.

In some embodiments, the package has one or more patterned die cuts that pass through the heat-sealable inner layer but not through the outer layer. In certain embodiments, one patterned die cut is situated substantially within the first folded portion of the gusset, and a second patterned die cut is situated substantially within the second folded portion of the gusset. For example, the first folded portion may have a side fold that divides the first folded portion into an outward-facing panel portion and an inward-facing panel portion, and the patterned die cut may be formed in the heat-sealable inner layer of the outward-facing folded portion. Similarly, the second folded portion may have a second side fold that divides the second folded portion into a second outward-facing panel portion and a second inward-facing panel portion, and the second patterned die cut may be formed in the heat-sealable inner layer of the second outward-facing folded portion.

As illustrated in FIG. 1, a package 10 may have one or more gussets 14 formed at the top 16 of the package 10 between a forward-facing panel 20 and a rearward-facing panel 22. The bottom 18 of the package 10 may be rectangular and flat, thereby allowing the package 10 to stand in the illustrated vertical orientation, such as when placed on a shelf of table. The bottom 18 may be formed in various configurations, however.

It should be noted that he directions "top," "bottom," "rearward," and "forward" are generally used to describe aspects of the package 10 in relation to the orientation of package 10 in FIG. 1. The package 10 may be produced in various configurations. For example, the package 10 may also be designed to rest on the rearward-facing panel 22 or forward-facing panel 20. The package 10 may also be designed to rest on a side having a gusset 14. The package 10 may also be formed as a pillow pouch or in any other configuration that includes at least one gusset 14.

The top 16 of the package 10 may include a transverse heat seal 12 which heat seals the forward-facing panel 20 and the rearward-facing panel 22 together. A center gusset fold 24 may divide the gusset 14 into a forward-folded portion 19 and a rearward folded portion 17. The transverse heat seal 12 may also heat seal the inner mating surfaces of the forward folded portion 19 and the inner mating surfaces of the rearward folded portion 17 together.

Figure 2:
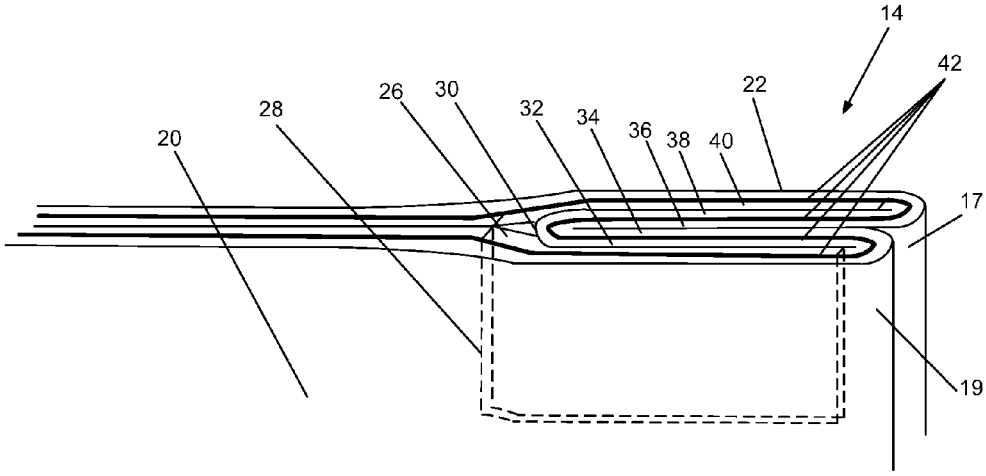
FIG. 2 is a detail view, illustrating a gusset in accordance with one or more embodiments of the present invention.

As illustrated in FIG. 2, one or both of forward folded portion 19 and rearward folded portion 17 of the gusset 14 may include a patterned die cut 28 situated within a layer of heat sealable material. For example, the forward folded portion 19 may comprise a forward-facing panel 20 that is laminated to a forward-facing panel seal layer 26 via a layer of pressure-sensitive adhesive 42 and a forward folded panel mating layer 34 that is laminated to a forward folded panel seal layer 32 via the layer of pressure-sensitive adhesive 42. The forward facing panel seal layer 26 may include a patterned die cut 28 passing therethrough and may be heat sealed to the forward folded portion seal layer 32 by the transverse heat seal which extends across the top of the package. The rearward folded portion 17 may comprise a rearward-facing panel 22 that is laminated to a rearward-facing panel seal layer 40 via a layer of pressure-sensitive adhesive 42 and a rearward folded panel mating layer 36 that is laminated to a rearward folded panel seal layer 38 via a layer of pressure-sensitive adhesive 42. The rearward facing panel seal layer 40 may also include a patterned die cut passing therethrough and may be heat sealed to the rearward folded portion seal layer 38 by the transverse heat seal which extends across the top of the package.

The one or more patterned die cuts 28 may be formed in various shapes. For example, the patterned die cut 28 may be rectangular in shape as illustrated. The patterned die cut 28 may be placed in one or more of the heat sealable layers of the gusset. For example, the patterned die cut 28 may be formed in the forward facing seal layer 26, the forward folded portion seal layer 32, the rearward facing seal layer 40 and/or the rearward folded portion seal layer 38.

Figure 3:
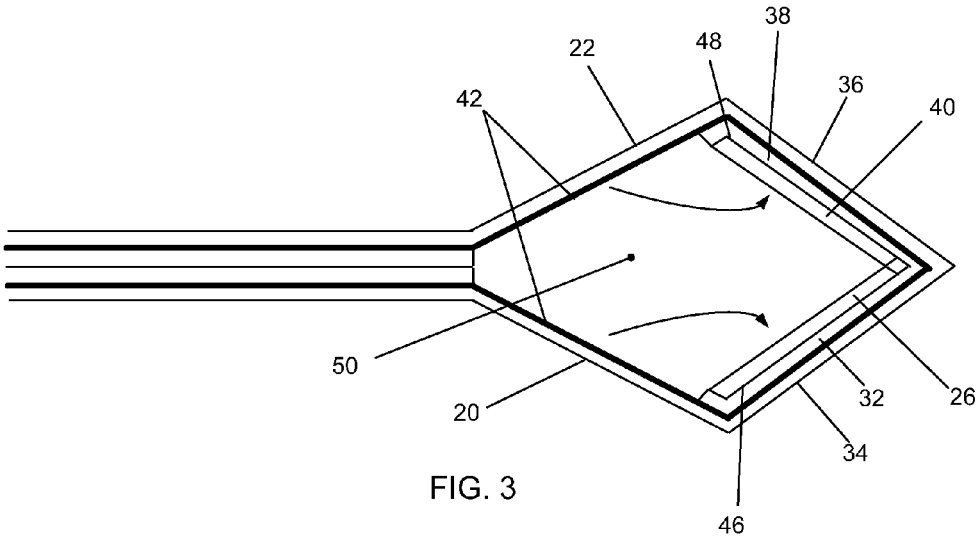
FIG. 3 is a top view, illustrating a gusset in accordance with one or more embodiments of the present invention.

As illustrated in FIG. 3, the placement of the patterned die cuts 28 in the locations illustrated in FIG. 2 allows for a resealable pour spout to be formed when the gusset 14 is unfolded. For example, when the forward portion 19 and the rearward folded portion 17 are unfolded, the die cut portions of the forward facing panel seal layer 26 and the rearward facing panel seal layer 40 may delaminate from the pressure sensitive adhesive 42 to reveal a pour spout opening 50 in the top of the package. The forward facing panel seal layer 26 and the rearward facing panel seal layer 40 may remain affixed to the forward folded portion seal layer 32 and the rearward folded portion seal layer 38 via a heat seal. When the pour spout opening 50 is formed, the contents of the package may be poured out of the pour spout opening 50 or otherwise accessed through the pour spout opening 50. The pour spout may then be resealed by folding the forward folded portion 19 and the rearward folded portion 17 back to the folded state of FIG. 2 and applying pressure to the gusset 14 to reseal the rearward facing panel seal layer 40 and forward facing panel seal layer 26 to the rearward facing panel 22 and the forward facing panel 20, respectively.

The flexible package material may comprise various layers. In some embodiments, the package material comprises an inner heat-sealable layer, a pressure-sensitive adhesive layer and an outer layer. Preferably the outer layer has a higher melt temperature than the inner layer. Various polymeric films may be used for the heat-sealable inner layer including, but not limited to, polyolefins, polyamides and other thermoplastic polymers. For example, the inner layer may comprise a biaxially-oriented polypropylene film. The outer layer or an intermediate layer may comprise a material with good barrier properties such as such as polyethylene terephthalate ("PET") and/or metalized films or foils. Additional layers, including additional print layers may also be provided.

In some embodiment, the pressure-sensitive adhesive layer is coextensive with the inner and outer layers. In other embodiments, the pressure sensitive adhesive is pattern applied in the functional region, i.e., the region of the patterned die cut. In such an embodiment, a conventional laminating adhesive may employed over the remaining area to seal the outer layer and inner layer together. Various pressure sensitive adhesives may be used to form the pressure adhesive layer. The pressure sensitive adhesive may comprise an elastomer compound with a suitable tackifier (e.g., a rosin ester). Exemplary elastomers include natural rubber, nitriles, butyl rubber, acrylics, styrene block copolymers, vinyl ethers, and ethylene-vinyl acetate.

B. Methods of Manufacturing Packages Having Resealable Pour Spouts

In another aspect, a method of manufacturing a package with a resealable pour spout is provided. The method may include providing a continuous web of a package material comprising a heat-sealable inner layer, an outer layer, and a pressure-sensitive adhesive disposed between the inner layer and the outer layer; cutting a patterned die cut through the heat-sealable inner layer; folding the package material such that the patterned die cut is located within a gusset, the gusset having a center fold that divides the gusset into a first folded portion and a second folded portion; and heat sealing the package material to form a transverse heat-seal region extending across the gusset and proximal to the patterned die cut whereby the first folded portion is sealed to itself by mating surfaces of the heat-sealable inner layer and the second folded portion is sealed to itself by mating surfaces of the heat-sealable inner layer.

In some embodiments, the pressure-sensitive adhesive is not applied coextensively with the inner and outer layers, but may be pattern-applied in functional regions of the packaging material, i.e., in regions where the patterned die cuts are to be placed. A conventional laminating adhesive, e.g., a permanent adhesive, may employed over the remaining area to affix the outer layer and inner layer together. Thus, although the package may be formed from a continuous web of a package material, the pressure-sensitive adhesive need not be uniformly applied across the package material.

The methods may be integrated in flexible packaging converting processes to produce packages having resealable pour spouts. For example, the methods may be used in flow-wrap applications, such as in vertical form, fill and seal packaging systems.

Figure 4:
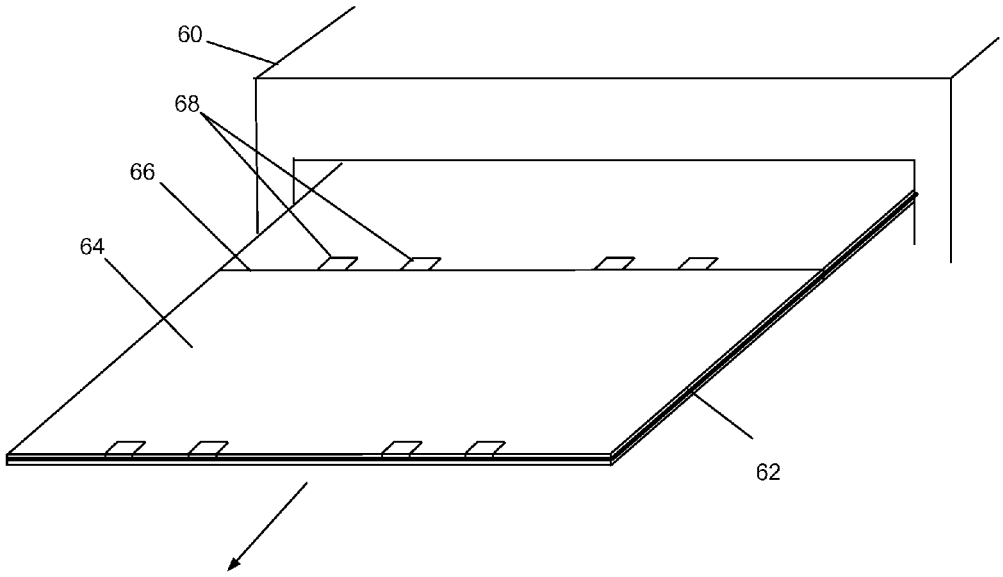
FIG. 4 is a perspective view, illustrating part of a method of manufacturing package having a resealable pour spout in accordance with one or more embodiments of the present invention.

As illustrated in FIG. 4, a cutting tool 60, such as a cutting die, may be used to impart patterned die cuts 68 into the inner heat-sealable layer 64 of a laminate package wrap 62. For example, the cutting tool 60 may include a rotary or flatbed cutting die. In an exemplary embodiment, the patterned die cuts 68 may pass through the heat sealable layer 64 but do not pass through the outer layer of the laminate package wrap 62.

The cutting tool 60 may also provide a transverse cut 66 through the laminate package wrap 62 adjacent to the patterned die cuts 68. The transverse cut 66 may pass all the way through the laminate package wrap. The transverse cut 66 may be made by the same or different cutting tool that imparts the patterned die cuts 68 in the heat-sealable layer 64. Accordingly, the transverse cut 66 may be made before, concurrently, or after the cutting tool 60 imparts the patterned die cuts 68 in the heat-sealable layer 64. In some embodiments, the transverse cut 66 is made prior to folding or forming the package from the laminate package wrap 62. In other embodiments, the transverse cut 66 is made during a fold and form process or after a fold and form process.

Figure 5:
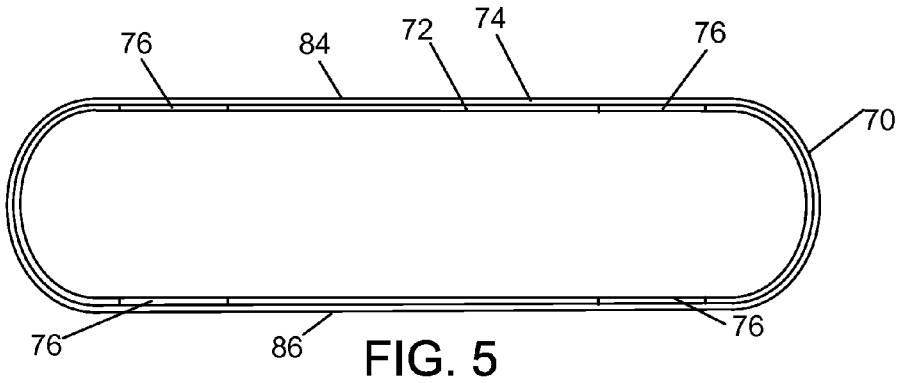
FIG. 5 is a top view, illustrating a package in accordance with one or more embodiments of the present invention in an unfolded state.
Figure 6:
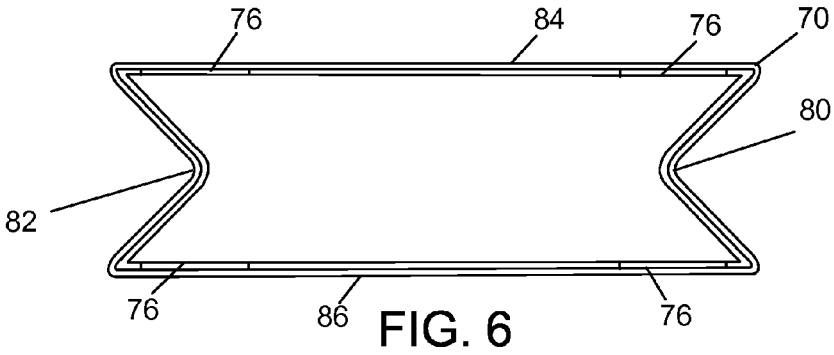
FIG. 6 is a top view, illustrating a package in accordance with one or more embodiments of the present invention in an partially folded state.
Figure 7:
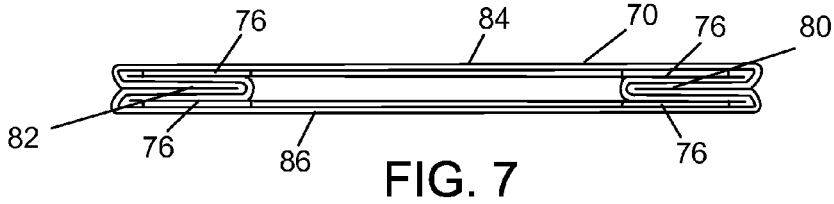
FIG. 7 is a top view, illustrating a package in accordance with one or more embodiments of the present invention in a folded state.

A folding process for forming a side-gusseted package with a resealable pour spout is illustrated in FIGS. 5-7. In the illustrated embodiment, the package 70 has been formed into a tube having an inner heat-sealable layer 72 that is affixed to an outer layer 74 by a pressure-sensitive adhesive. The package may be formed into a tube shape by various folding and forming processes. For example, the laminate package wrap 62 of FIG. 4 may be formed into the package 70 by overlapping the side edges of the wrap 62 and providing a permanent or non-permanent adhesive in the overlapping region. Alternatively, the heat-sealable layer 64 of opposite sides of the wrap 62 may be heat sealed together to form a fin seal. Other methods may also be used for forming a tube-shaped package 70.

As illustrated in FIG. 6, opposite side portions 80 and 82 of the top of the tube 70 may then be folded inward so that the folded portions extend between die cut portions 76 of the heat-sealable layer 72 of the front and back panels 84 and 86. As illustrated in FIG. 7, the side portions 80 and 82 may be folded between the front and back panels 84 and 86 to form side gussets. The die cut portions 76 are "captured" within each of the gussets between the folded side portions 82 and 80 and the front and back panels 84 and 86. Once the gussets are folded as illustrated in FIG. 7, the top of the package 70 may be heat sealed, such as by compressing the top of the package 70 within a heat-sealing die, to form a transverse heat seal region across the top of the package 70. The heat-seal region may extend across the gusset and the die cut portions 76 so that the folded side portions 82 and 80 are each sealed vis-à-vis the mating surfaces of the heat-sealable inner layer 72. The package 70 may be filled with a product, such as a food product, before, during or after folding the gussets of the package.

It should be understood that the foregoing relates only to the preferred embodiments of the present application and that numerous changes and modifications may be made herein without departing from the general spirit and scope of the invention as defined by the following claims and the equivalents thereof.

The invention claimed is:

1. A package with a resealable pour spout comprising:

a package material comprising a heat-sealable inner layer, an outer layer, and a pressure-sensitive adhesive disposed between the inner layer and the outer layer;

a gusset formed of the package material, the gusset having a center fold that divides the gusset into a first folded portion and a second folded portion;

a transverse heat-seal region extending across the gusset whereby the first folded portion is sealed to itself by mating surfaces of the heat-sealable inner layer and the second folded portion is sealed to itself by mating surfaces of the heat-sealable inner layer; and a patterned die cut formed in the heat-sealable inner layer, at least a portion of the patterned die cut being adjacent to the transverse heat-seal region of the gusset so as to allow a portion of the inner layer to delaminate and expose a portion of the pressure-sensitive adhesive when the center fold is unfolded and the resealable pour spout is opened.

2. The package of claim 1, wherein the package further comprises a second gusset formed of the package material.

3. The package of claim 1, wherein the package material further comprises a print layer disposed between the outer layer and the pressure-sensitive adhesive.

4. The package of claim 1, wherein the patterned die cut is situated substantially within the first folded portion of the gusset.

5. The package of claim 4, further comprising a second patterned die cut formed in the heat-sealable inner layer, wherein the second patterned die cut is situated substantially within the second folded portion of the gusset.

6. The package of claim 4, wherein the first folded portion has a side fold that divides the first folded portion into an outward-facing panel portion and an inward-facing panel portion, and wherein the patterned die cut is formed in the heat-sealable inner layer of the outward-facing folded portion.

7. The package of claim 5, wherein the first folded portion has a side fold that divides the first folded portion into an outward-facing panel portion and an inward-facing panel portion, and wherein the patterned die cut is formed in the heat-sealable inner layer of the outward-facing folded portion.

8. The package of claim 7, wherein the second folded portion has a second side fold that divides the second folded portion into a second outward-facing panel portion and a second inward-facing panel portion, and wherein the second patterned die cut is formed in the heat-sealable inner layer of the second outward-facing folded portion.

9. A package with a resealable pour spout comprising:

a tube wall having a heat-sealable inner layer, an outer layer, and a pressure-sensitive adhesive disposed between the inner layer and the outer layer;

a side gusset formed in the tube wall, the side gusset having a center fold that divides the gusset into a first folded portion and a second folded portion;

a transverse heat-seal region extending in a transverse direction across the tube wall and extending across the side gusset proximal to form an end seal whereby the first folded portion is sealed to itself by mating surfaces of the heat-sealable inner layer and the second folded portion is sealed to itself by mating surfaces of the heat-sealable inner layer;

at least one patterned die cut formed in the heat-sealable inner layer, at least a portion of the at least one patterned die cut being adjacent to the transverse heat-seal region of the gusset so as to allow a portion of the inner layer to delaminate and expose a portion of the pressure-sensitive adhesive when the center fold is unfolded and the resealable pour spout is opened.

10. The package of claim 9, wherein the package further comprises a second gusset formed in the tube wall.

11. The package of claim 9, wherein the tube wall further comprises a print layer disposed between the outer layer and the pressure-sensitive adhesive.

12. The package of claim 9, wherein the patterned die cut is situated substantially within the first folded portion of the gusset.

13. The package of claim 12, further comprising a second patterned die cut formed in the heat-sealable inner layer, wherein the second patterned die cut is situated substantially within the second folded portion of the gusset.

14. The package of claim 12, wherein the first folded portion has a side fold that divides the first folded portion into an outward-facing panel portion and an inward-facing panel portion, and wherein the patterned die cut is formed in the heat-sealable inner layer of the outward-facing folded portion.

15. The package of claim 13, wherein the first folded portion has a side fold that divides the first folded portion into an outward-facing panel portion and an inward-facing panel portion, and wherein the patterned die cut is formed in the heat-sealable inner layer of the outward-facing folded portion.

16. The package of claim 15, wherein the second folded portion has a second side fold that divides the second folded portion into a second outward-facing panel portion and a second inward-facing panel portion, and wherein the second patterned die cut is formed in the heat-sealable inner layer of the second outward-facing folded portion.

17. A method of manufacturing a package with a resealable pour spout comprising:

providing a continuous web of a package material comprising a heat-sealable inner layer, an outer layer, and a pressure-sensitive adhesive disposed between the inner layer and the outer layer;

cutting a patterned die cut only through the heat-sealable inner layer;

folding the package material such that the patterned die cut is located within a gusset, the gusset having a center fold that divides the gusset into a first folded portion and a second folded portion; and heat sealing the package material to form a transverse heat-seal region extending across the gusset and proximal to the patterned die cut whereby the first folded portion is sealed to itself by mating surfaces of the heat-sealable inner layer and the second folded portion is sealed to itself by mating surfaces of the heat-sealable inner layer.

18. The method of claim 17, wherein the step of cutting the patterned die cut is performed prior to folding the package material such the patterned die cut is located within the gusset.

19. The method of claim 17, wherein the step of cutting the patterned die cut is performed prior to heat sealing the package material to form the transverse heat-seal region.

20. The method of claim 17, wherein the step of folding package material comprises folding the package material into a shape of a tube.

* * * * *